US005090683A

United States Patent [19]

Kamath et al.

[11] Patent Number: 5,090,683

[45] Date of Patent: Feb. 25, 1992

[54] ELECTRONIC SHEET ROTATOR WITH DESKEW, USING SINGLE VARIABLE SPEED ROLLER

[75] Inventors: Venkatesh H. Kamath; Barry P. Mandel, both of Fairport; Ted A. Beer, Webster; Russell J. Sokac, Rochester, all of N.Y.

[73] Assignee: Xerox Corporation, Stamford, Conn.

[21] Appl. No.: 560,872

[22] Filed: Jul. 31, 1990

[51] Int. Cl.[5] ..... B65H 7/14

[52] U.S. Cl. ..... 271/227; 271/184; 271/261

[58] Field of Search ..... 271/227, 261, 184, 185

[56] References Cited

U.S. PATENT DOCUMENTS

| | | | |
|---|---|---|---|
| 3,240,487 | 3/1966 | Templeton . | |
| 3,589,808 | 6/1971 | Del Vecchio . | |
| 3,603,446 | 9/1971 | Maxey | 271/227 X |
| 3,758,104 | 9/1973 | Daily . | |
| 4,076,408 | 2/1978 | Reid et al. . | |
| 4,082,456 | 4/1978 | Schroter . | |
| 4,155,440 | 5/1979 | Bogdanski et al. . | |
| 4,438,917 | 3/1984 | Janssen et al. . | |
| 4,500,086 | 2/1985 | Garavuso . | |
| 4,511,242 | 4/1985 | Ashbee et al. . | |
| 4,669,719 | 6/1987 | Fratangelo . | |
| 4,727,402 | 2/1988 | Smith . | |
| 4,855,607 | 8/1989 | Eckl | 271/227 X |
| 4,877,234 | 10/1989 | Mandel | 271/184 X |
| 4,955,964 | 9/1990 | Hain | 271/184 X |
| 4,955,965 | 9/1990 | Mandel | 271/184 X |
| 4,971,304 | 11/1990 | Lofthus . | |

OTHER PUBLICATIONS

Xerox Disclosure Journal, vol. 12, No. 4, Jul./Aug. 1987 (pp. 205–206).

IBM Technical Disclosure Bulletin, vol. 14, No. 7, Dec. 1971 (p. 2179).

Research Closure, Nov. 1979.

*Primary Examiner*—Richard A. Schacher

*Attorney, Agent, or Firm*—Oliff & Berridge

[57] ABSTRACT

A device for selectively turning documents includes first and second drive rollers aligned along an axis which is transverse to a process direction along which documents are fed, and first and second follower rollers cooperatively peripherally aligned with the first and second drive rollers, respectively. One of the drive rollers is operated at a substantially constant peripheral velocity by a first drive which is a constant velocity motor while the other drive roller is operated at a variable peripheral velocity by a variable speed drive so that the document is turned. Thus, only a single variable speed drive, such as, for example a stepper motor or servo system, is required. The variable speed drive is driven through a variable velocity profile to control the amount of rotation of the document. Preferably the document is turned approximately 90°. By placing a pair of sensors adjacent the drive rollers, the skew of the document prior to being rotated can be measured and used to determine the velocity profile for controlling the variable speed motor. After the document is rotated, the same two sensors are used to detect the skew, if any, of the trailing edge of the turned document for correction of the velocity profile used to rotate subsequent documents. An additional mechanism can be provided for shifting the connection of the constant velocity and variable speed motors between the first and second drive rollers so that a sheet can be rotated in opposite directions.

44 Claims, 8 Drawing Sheets

ELECTRONIC SHEET ROTATOR WITH DESKEW, USING SINGLE VARIABLE SPEED ROLLER

BACKGROUND OF THE INVENTION

1. Field of the Invention

The present invention relates to devices for rotating documents, and in particular to devices for electronically rotating documents 90° while deskewing the documents using a single variable speed drive roller and an intelligent control algorithm.

2. Description of Related Art

Sheet rotation is fast becoming a highly sought after capability to enable the connection of third party finishing devices (i.e., folders, direct mail systems, etc.) to pre-existing copiers and printers. It is common for finishing devices such as, for example, buckle folders, saddle stitchers, direct mail systems, compiler/staplers, and the like, to require documents to be input with their short edge first. However, it is also common for copiers and printers to output documents with their long edge first. Thus, a document rotation device is needed to rotate documents 90° between the output of the copier or printer and the input of the finishing device.

It is also desirable for a 90° rotation device to be selectively operable to rotate documents since, depending on the size of the documents, some documents are outputted by copiers and printers with their short edge first. A device which selectively rotates documents is also useful for establishing set distinction between a plurality of sets of documents outputted by the copier or printer in a continuous manner. That is, sets of documents can be distinguished from one another by alternately rotating and not rotating consecutive sets.

One problem with current document rotation systems is that they require edge registration guides to control the amount of rotation of the document. Since the documents must be forcibly driven into these edge registration guides, corners and edges of the documents can be damaged. This is particularly the case when the documents are light-weight, delicate sheets. Additionally, the use of edge registration guides increases the possibility of documents becoming jammed in the rotator. Furthermore, if corners or edges of the documents are already damaged or are bent or folded after engagement with the edge registration guides, the documents may not be registered properly.

Thus, it is desirable to use a sheet rotation device which does not require edge registration guides. However, edge registration guides perform a useful function in that they "automatically" correct for skew inaccuracies after rotation of the documents because all documents are registered against the same registration guide which is always in the same orientation. Thus, it is also desirable to provide a sheet rotation device which deskews as well as rotates a document without the use of edge registration guides.

It is known to provide separate devices for deskewing or rotating which accomplish deskewing or rotation with multiple rollers, each being driven at different speeds and/or in opposite directions. These devices use at least two servo systems or stepper motors, to achieve the deskewing or rotating procedure. Servo systems and stepper motors are expensive and also require monitoring and control separate from the monitoring and control provided for the other constant velocity feed rollers located throughout the remainder of the system's document feed path. Thus it is desirable to provide a rotating device which achieves rotation and deskewing with only one servo system or stepper motor.

Xerox Disclosure Journal, Vol. 12, No. 4, p. 205 (July/Aug. 1987) to Huggins discloses apparatus for detecting and correcting document skew. The difference in time between the detection of the lead edge of the document by two spaced rollers is used to calculate the input skew angle of the document. Each of the rollers is driven by a separate stepper motor. Once the amount of input skew is determined, control logic can then be arranged to increase the number of steps made by one of the stepper motors, or decrease the number of steps made by the other stepper motor, or a combined increase and decrease of each of the stepper motors can be used during the time that the paper is being driven by the rollers. The rollers can also be alternately differentially driven for a short time period to laterally move and thus side-register the document.

IBM Technical Disclosure Bulletin, Vol. 14, No. 7, p. 2179 (Dec. 1971) to Groenewald and Towne discloses a document cornering mechanism which utilizes a plurality of rollers and a side registration guide to rotate a document 90°.

A Research Disclosure Bulletin dated Nov., 1979, and entitled "Means To Correct Document Skew" discloses a document feeder for use on a copier which corrects for document skew using registration gates and variable speed rollers. The means to correct for document skew is disclosed in conjunction with U.S. Pat. No. 4,076,408 to Reid et al.

U.S. Pat. No. 4,500,086 to Garavuso, assigned to Xerox Corporation, discloses a rotating inverter for rotating documents 180°. Rotation is accomplished by opening and closing two pairs of pivoting nips that are driven in opposite directions. The system does not include deskew, and imparts extremely high accelerations onto the sheet due to the roll actuation scheme used.

U.S. Pat. No. 4,438,917 to Janssen et al discloses a dual motor aligner which utilizes two independently controlled servo motors to deskew documents. A skew is deliberately generated on the sheets before entering the two servo controlled rollers, and two sensors are used to detect the skew and lateral position of the sheet. The velocity profile of the two servo driven rollers is then selected from a look-up table to achieve deskew and side registration. The system does not provide sheet rotation capability other than to correct for skew.

U.S. Pat. No. 4,511,242 to Ashbee et al discloses a machine for deskewing documents using two variable speed rollers. This patent describes a system for utilizing the capabilities of the "Dual Motor Aligner" described in the above-mentioned U.S. Pat. No. 4,438,917. The system uses manual and electrical feedback to relate document skew to copy output skew. The Dual Motor Aligner is then used to compensate by adjusting the copy paper position. In addition, the unit senses and corrects for the skew generated during the feeding of the copy paper. The system does not provide sheet rotation capability.

U.S. Pat. No. 4,971,304 issued Nov. 20, 1990 to Lofthus, entitled "Apparatus and Method for Combined Deskewing and Side Registering", assigned to Xerox Corporation, discloses an apparatus and method for combined deskewing and side registering documents. This apparatus utilizes two variable speed rollers to deskew and side register documents having an initially unknown skew. This system also does not provide sheet rotation capability other than to correct for skew and side edge registration.

U.S. Pat. No. 4,669,719 to Fratangelo, assigned to Xerox Corporation, discloses an apparatus for rotating sheets 90° by contacting the document with a series of free floating balls arranged so that the balls selectively retard one side of the sheet moving along a conveyor as well as with a side registration member. This device relies upon gravity to rotate a sheet and must be arranged so that a sheet moves vertically therethrough.

U.S. Pat. No. 3,240,487 to Templeton discloses an apparatus for deskewing documents by rotating a first set of rollers located downstream of a second set of rollers in a direction opposite to that of the second set of rollers.

U.S. Pat. No. 3,589,808 to DelVecchio, assigned to Xerox Corporation, discloses a xerographic reproducing machine which outputs sheets either short-edge first or long-edge first. A sheet can be rotated 90° by being pivoted about a fixed turning post as it is transferred from a first to a second feed path arranged at an angle of 90° to the first feedpath.

U.S. Pat. No. 3,758,104 to Daily discloses a sheet turning apparatus which rotates sheets 90° by contacting the sheet with two rollers, each being driven at a different constant speed. This system does not compensate for input skew and is insensitive to wear or drifting of the various components.

U.S. Pat. No. 4,082,456 discloses an apparatus for deskewing sheets.

U.S. Pat. No. 4,155,440 to Bogdanski et al discloses a document turning station for rotating documents 90° utilizing a plurality of rollers which rotate at different constant velocities to rotate the document and register the document against a side registration guide. This device does not detect or compensate for input skew and requires registration guides.

U.S. Pat. No. 4,727,402 to Smith, assigned to Xerox Corporation, discloses an apparatus for producing sets of signatures. The present invention can be used with a signature producing device since the completed signatures usually must be rotated 90° prior to being stacked and bound by, for example, stapling, stitching or gluing.

The disclosed apparatus may be readily operated and controlled in a conventional manner with conventional control systems. Some additional examples of control systems for various prior art copiers with document handlers, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general, and preferable, to program and execute such control functions and logic with conventional software instructions for conventional microprocessors. This is taught by the above and other patents and various commercial copiers. Such software will of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems.

All references cited in this specification, and their references, are incorporated by reference herein where appropriate for appropriate teachings of additional or alternative details, features, and/or technical background.

OBJECTS AND SUMMARY OF THE INVENTION

It is an object of the present invention to provide a rotation device which does not require registration edge guides to rotate or deskew a document.

It is another object of the present invention to provide a document rotation device which automatically compensates for input skew of a document while rotating the document without requiring any additional hardware.

It is another object of the present invention to provide a rotation device which automatically corrects for roller wear or rotation speed fluctuations (drift) which occur over extended periods of use.

It is another object of the present invention to provide a document rotation device which automatically side registers documents while rotating them 90° without using registration edge guides.

It is another object of the present invention to provide a rotation device which rotates and deskews documents using only one variable speed motor, thus reducing production costs and simplifying control.

It is another object of the present invention to provide a rotation device which is capable of rotating a document in opposite directions using only one variable speed motor.

It is a further object of the present invention to provide a device for rotating documents which is operable in a bypass mode while still compensating for document skew.

To achieve the foregoing and other objects, and to overcome the shortcomings discussed above, a device for selectively turning documents is disclosed which includes first and second drive rollers aligned along an axis which is transverse to a process direction along which documents are fed, and first and second idler rollers cooperatively peripherally aligned with the first and second drive rollers, respectively. One of the drive rollers is operated at a substantially constant peripheral velocity by a first operating means while the other drive roller is operated at a variable peripheral velocity by a second operating means so that the document is turned. Thus, only a single variable speed drive, such as, for example a stepper motor or servo system, is required. The second operating means is driven through a variable velocity profile to control the amount of rotation of the document. Preferably the document is turned approximately 90°. By placing a pair of sensors adjacent the drive rollers, the skew of the document prior to being rotated can be measured and used to determine the velocity profile for controlling the second operating means. After the document is rotated, the same two sensors are used to detect the skew, if any, of the trailing edge of the turned document for correction of the velocity profile used to rotate subsequent documents. The apparatus is also operable in a bypass mode so that sheets can be selectively rotated or not rotated. An additional mechanism can be provided for shifting the connection of the first and second operating means between the first and second drive rollers so that a sheet can be rotated in opposite directions. This same shifting mechanism can also be used to side register sheets that are not rotated by the device by shifting the drive rollers in a direction transverse to the process direction while they grip a document.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
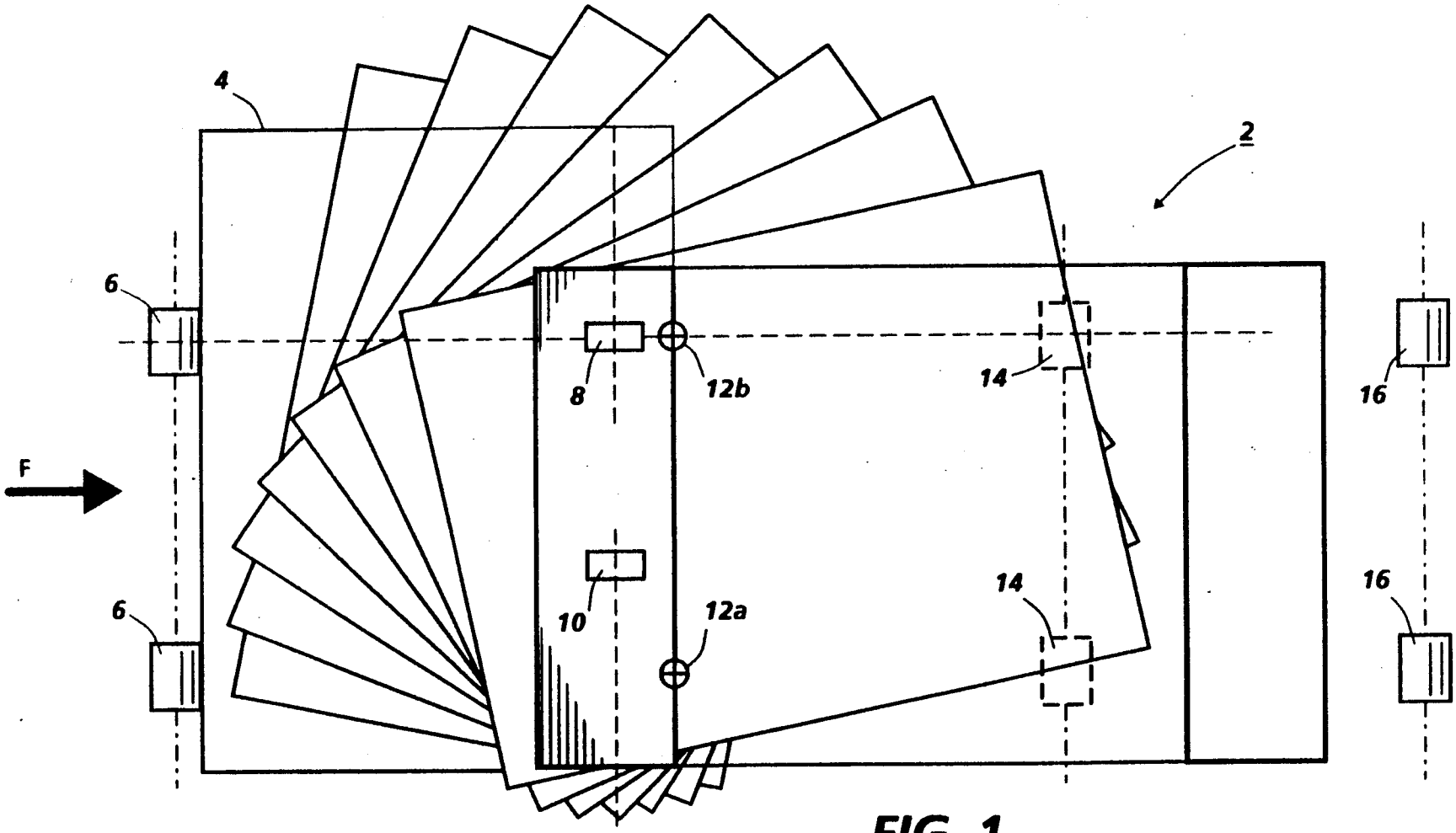
FIG. 1 is a schematic overhead plan view of a document turning device according to a first embodiment of the present invention which utilizes a single pair of sensors and a single variable speed drive.

FIG. 1 shows a document turning device 2 according to a first embodiment of the present invention. A sheet 4 which enters document turning device 2 long edge first along a process direction F is illustrated at a plurality of incremental positions as the document 4 is rotated 90° and passed through document turning device 2. A first pair of input drive rollers 6, which could be part of the document turning device 2 or outlet rollers of a device located upstream of document turning device 2, such as a copier or printer, rotate at a constant velocity to receive and convey sheet 4 to drive rollers 8 and 10. Initially, drive rollers 8 and 10 are rotating at the same speed as input rollers 6. As the sheet 4 is conveyed by drive rollers 8 and 10, a pair of detectors 12*a*, 12*b* detect the leading edge of the sheet and indicate the presence of the sheet to a controller. After waiting a predetermined time period, the speed of drive roller 10 is varied (decreased in the illustrated preferred embodiment) while drive roller 8 continues to rotate at constant velocity so that sheet 4 is rotated. After a second predetermined time period elapses, the speed of drive roller 10 is returned to the constant speed of drive roller 8 so that sheet 4 stops turning, preferably after being rotated 90°. It is understood that each of the rollers illustrated in the figures includes a corresponding follower roller which is pressed into contact therewith to provide a nip for gripping and conveying the document 4 therebetween. A pair of output rollers 14 located downstream of drive rollers 8 and 10, and also including corresponding follower rollers, receive the document after being rotated and convey document 4 out of turning device 2. Rollers 14 are mounted on a common shaft which is movable in a direction out of the page, away from their corresponding follower rollers. As a document 4 is being rotated, output rollers 14 are separated from their corresponding follower rollers so that document 4 can be inserted therebetween as it is being rotated. After rotation is complete, output rollers 14 are moved back into contact with their corresponding follower rollers to grip and convey document 4 out of turning device 2 and onto downstream rollers 16.

Figure 2:
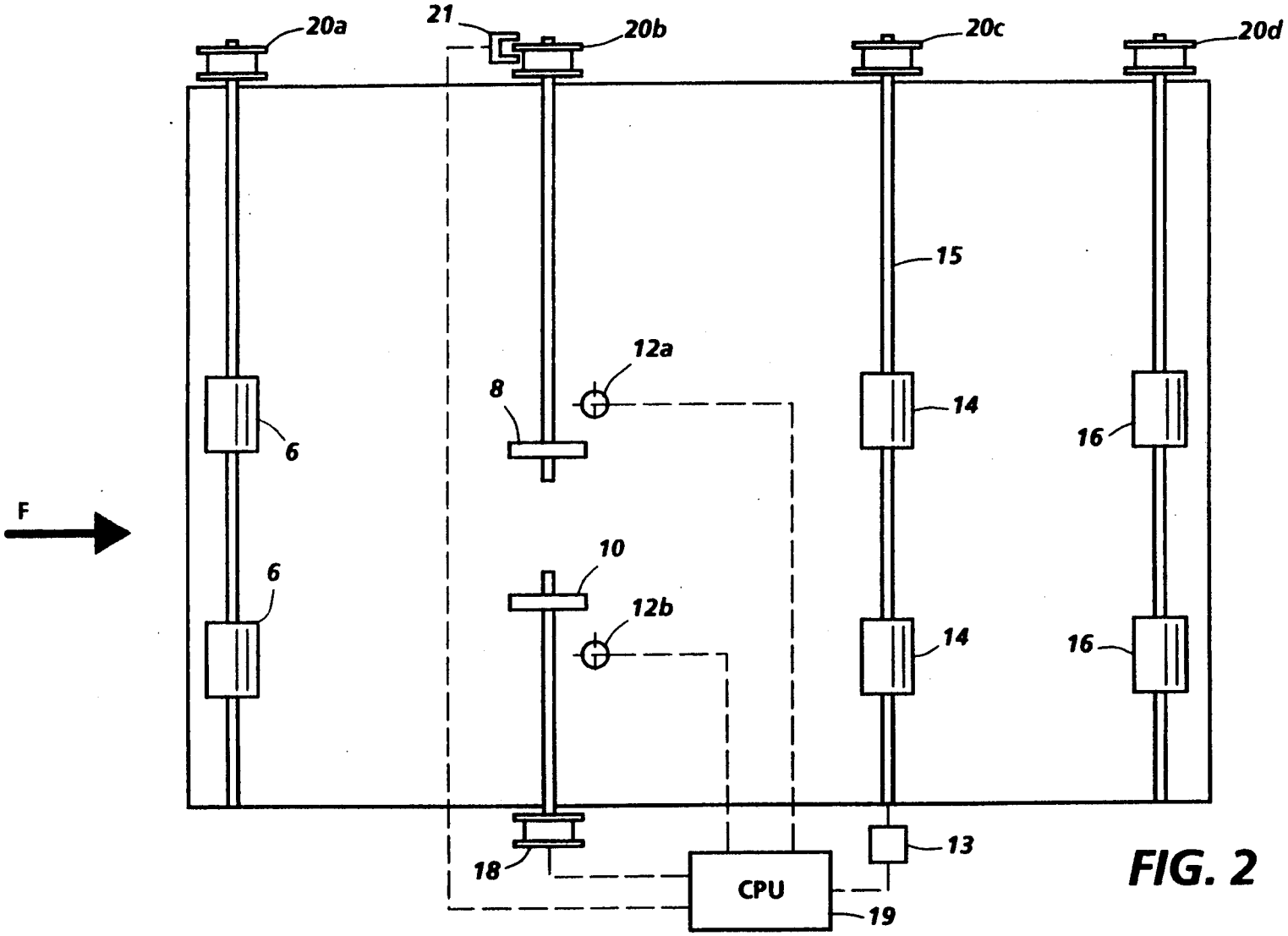
FIG. 2 is a schematic overhead plan view of the document turning device of FIG. 1.

FIG. 2 illustrates the various components and structure for controlling the operation of turning device 2. Each of the pairs of continuous constant speed rollers 6, 14 and 16 are provided on a corresponding shaft which is driven at a continuous, substantially constant velocity by one of operating means 20*a*, 20*c*, and 20*d*, respectively. Additionally, drive roller 8 is attached to operating means 20*b* through a shaft and is driven at the same continuous constant speed. Each of the operating means 20*a–d* could be a constant speed motor, however, preferably each of the operating means is merely a passive pulley, each of the operating means 20*a–d* being attached to a common drive belt (not shown) which is driven by a single constant speed motor. This single constant speed motor can be synchronized with, or the same as, the motor which operates the paper feeding components of the printer or copier located upstream thereof. Thus, regardless of the fluctuations in the speed of the constant drive motor, all of the rollers 6, 8, 14 and 16 will be driven at the same speed. Drive roller 10 is attached to a second operating means 18 through a shaft. Second operating means 18 is capable of selectively operating drive roller 10 at a peripheral velocity which varies so that a document can be turned. Second operating means 18 is preferably a stepper motor or servo system. The speed at which second operating means 18 rotates drive roller 10 is controlled by, for example, a CPU 19.

CPU 19 operates according to an intelligent algorithm to determine a variable velocity profile which is used by second operating means 18 to operate drive roller 10. The algorithm is referred to as being "intelligent" because it is able to modify the velocity profile used to operate second operating means 18 based upon external data such as the input skew of a document entering turning device 2 and the output skew of documents exiting turning device 2. The operation of the intelligent algorithm will be described below. CPU 19 also controls the movement of shaft 15 which contains output rollers 14 by controlling engaging means 13 for placing output rollers 14 in the engaging position (where they are engaged with their corresponding follower idler rollers) before and after a document is turned and for placing output drive rollers 14 in the disengaged position while the document is being turned. Engaging means 13 is preferably a solenoid. It is understood that engaging means 13 could alternately move the idler rollers toward and away from output rollers 14 and their associated drive shaft 15. CPU 19 also receives information from an encoder 21 relating to the rotational velocity of first operating means 20*b*. When documents are conveyed through turning device 2 without being rotated, drive roller 10 must be rotated at the same speed as drive roller 8. Although the speed at which first operating means 20b should be operating is predetermined and thus known, since this value tends to fluctuate due to the characteristics of the continuous speed drive motor as well as due to wear and tear on the system components, an encoder 21 can provide CPU 19 with data relating to the instantaneous velocity of first operating means 20b so that second operating means 18 can operate roller 10 at the same speed as drive roller 8.

Figure 3:
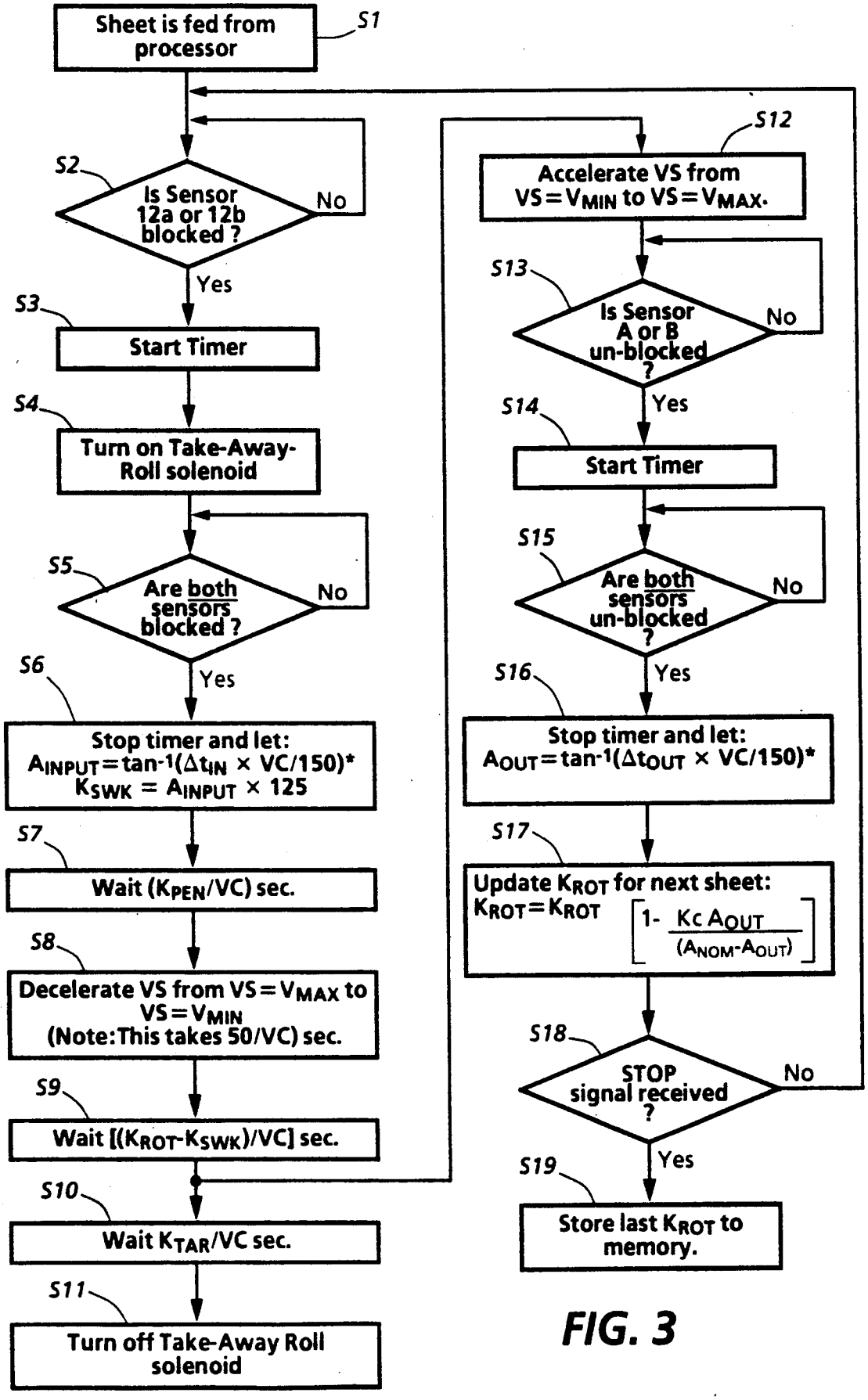
FIG. 3 is a block diagram illustrating an intelligent algorithm used to produce a variable velocity profile to control the single variable speed drive to turn a document 90° as well as correct for input skew and output skew if any.

Document turning device 2 operates to rotate a document 90° as follows. Sensors 12a and 12b are used to sense the lead edge and determine the input skew of each document. Second operating means 18, which can be, for example a stepper motor, is then decelerated and accelerated again using a specific algorithm that rotates the sheet 90°, plus or minus the input skew that was measured for that sheet. At this point, the sheet should theoretically have been rotated 90° and deskewed. However, if the velocity of the constantly driven turn roller 8 drifts, or the rollers begin to wear, it is possible that the actual sheet rotation will differ from the theoretically determined motion. Because of this possible difference, one more step is taken in the rotation process. As the sheet exits the turn rollers 8, 10 the two sensors 12a, 12b are used to determine the output skew of the sheet from its trail edge. If the sheet is not perfectly deskewed, this information is fed back to the controller (CPU 19) and the variable velocity profile is updated to compensate for the measured error. Since this process is carried out for every sheet, the system can continuously compensate for velocity drift, roller wear or other noises in the system. A flow chart for the complete control algorithm used is shown in FIG. 3.

In step 1 (S1), control of drive roller 10 is initiated when a sheet is fed from a processor located upstream of turning device 2. In step S2, the blockade of either sensor 12a or 12b is ascertained. After one of sensors 12a, 12b is blocked, a timer is initiated in step S3. At this point, in step S4, take away solenoid 13 is actuated to move shaft 15 so that output rollers 14 are disengaged from their corresponding follower rollers. In S5, the blockage of both sensors 12a and 12b is ascertained. Once both sensors 12a and 12b are blocked, the algorithm proceeds to step S6 where the velocity profile through which step motor 18 will be operated is determined. In step S6, the timer is stopped and its value is assigned to the variable $\Delta t_{in}$. Thus, the value of $\Delta t_{in}$ is proportional to the input skew of a document. The more the document is skewed, the greater the value of $\Delta t_{in}$. $\Delta t_{in}$ (and thus $A_{input}$) can be positive or negative depending on the direction of skew of the document. $\Delta t_{in}$ was assigned a positive value for a Clockwise skew and a negative value for a counterclockwise skew (i.e., if sensor 12a is blocked first, $\Delta t_{in}$ is positive) in the algorithm used with the described embodiment although the opposite arrangement can also be used as long as the algorithm is adjusted appropriately. The following calculations are then made in step S6:

$$A_{input}=\tan^{-1}(\Delta t_{in}\cdot VC/150)$$

$$K_{skw}=A_{inpur}125;$$

wherein, VC equals the velocity of the constantly driven roller 8. It is recalled that prior to turning a document, both drive rollers 8 and 10 are operated at the same constant velocity (VC) so that initially the document is conveyed along in the process direction (indicated by arrow F) without being turned. In step S7, a waiting period, $WAIT=K_{pen}/VC$ is determined, during which both drive rollers 8 and 10 are continued to be operated at the constant velocity after the lead edge of the document is sensed so that the lead edge of the document is conveyed a predetermined distance past rollers 8 and 10. This predetermined distance is the same for every document and controls the location of the side edge of each document after it is rotated. Thus, all of the rotated documents will be side registered upon exiting turning device 2. $K_{pen}$ is thus a predetermined constant value which is based upon the constant velocity speed VC of the apparatus, the distance between sensors 12a, 12b and drive rollers 8, 10 and the desired side registration position of outputted documents.

The velocity profile through which second operating means 18 is operated is determined in steps S8–S12. In the illustrated embodiment, the velocity profile involves decelerating drive roller 10 (by controlling, for example, a stepper motor 18) from an initial velocity $VS=V_{max}=VC$ (i.e., initially step motor is operating at the same speed as the constant velocity drive) to a minimum velocity $V_{min}$, holding the velocity of drive roller 10 at $V_{min}$ for a variable time period based upon the amount of turning required (e.g. to rotate 90° and compensate for input skew), and then accelerating roller 10 back up to the constant velocity motor speed VC. It is understood that other variable velocity profiles could also be used with the present invention. For example, the variable speed drive roller 10 could be brought to a complete stop or accelerated to speeds greater than VC. However, it has been determined that deceleration of drive roller 10 is preferable because it can turn smaller sheets and is less damaging to the documents. In particular, in step S8, the velocity VS of stepper motor 18 is decelerated from $V_{max}$ to $V_{min}$. A value of $V_{min}=0.2$ $V_{max}$ has been found to be preferable although other values for $V_{min}$ can also be used. After stepper motor 18 reaches $V_{min}$, its speed is held constant for a time period equal to $[(K_{rot}-K_{skw})/VC]$ seconds, wherein $K_{rot}$ defines a predetermined time period, based upon $V_{max}$, $V_{min}$, the time period required to decelerate and accelerate between $V_{max}$ and $V_{min}$, and the distance between driver rollers 8 and 10, required to rotate a document a desired amount, for example 90°. Thus, it is seen that the time period which roller 10 is maintained at $V_{min}$ depends upon $K_{rot}$ (i.e., the approximate amount of rotation desired (90°)) and $K_{skw}$ (i.e., the input skew of the document). After maintaining stepper motor 18 at a constant velocity $V_{min}$ for the appropriate time period, the velocity of stepper motor 18 is accelerated back to $V_{max}$, as shown in step S12. In step S11, the solenoid 13 is deactivated so that output rollers 14 engage the document and convey it out of turning device 2. Since output rollers 14 should not engage the document until drive roller 10 has reached the same velocity as drive roller 8, the deactivation of solenoid 13 is delayed, in step S10, for a time period equal to $(K_{tar}/VC)$ seconds, wherein $K_{tar}$ is a predetermined parameter.

Although the algorithm could proceed from step S12 to step S18, in order to correct for drift in the operation of the constant velocity motor as well as wear of the rollers in the system, steps S13–S17 are provided. The same sensors which detect the input skew (i.e., sensors 12a and 12b) can be used to detect the skew of the document after it has been rotated. Steps S13–S15 are similar to steps S2–S4 except that the time period required between the unblocking of each sensor is determined as $\Delta t_{out}$. The output skew angle $A_{out}$ is determined in step S16 according to the formula $A_{out} = \tan^{-1}(\Delta t_{out} \cdot VC/150)$. The time factor $K_{rot}$ required to rotate a document by, for example, 90° is then adjusted in step S17 to correct for output skew according to the formula:

$$K_{rot} = K_{rot}\left[1 - \frac{K_c A_{out}}{(A_{nom} - A_{out})}\right];$$

wherein $A_{nom}$ is a nominal angle through which the sheet is rotated while the variable speed roller is held at $V_{min}$ which is predetermined and $K_c$ is a correction factor which compensates for system noise and prevents over-correction from occurring. The algorithm then proceeds to step S18 where a determination is made as to whether or not more sheets are being inputted. If more sheets are being inputted, the algorithm returns to step S2 to begin the turning procedure and uses the updated value of $K_{rot}$ to do so. If no more sheets are being fed, or if it is not necessary or desired to turn these sheets (e.g., if 90° set distinction is desired) the algorithm proceeds to step S19 where the last value of $K_{rot}$ is stored in memory.

Figure 4:
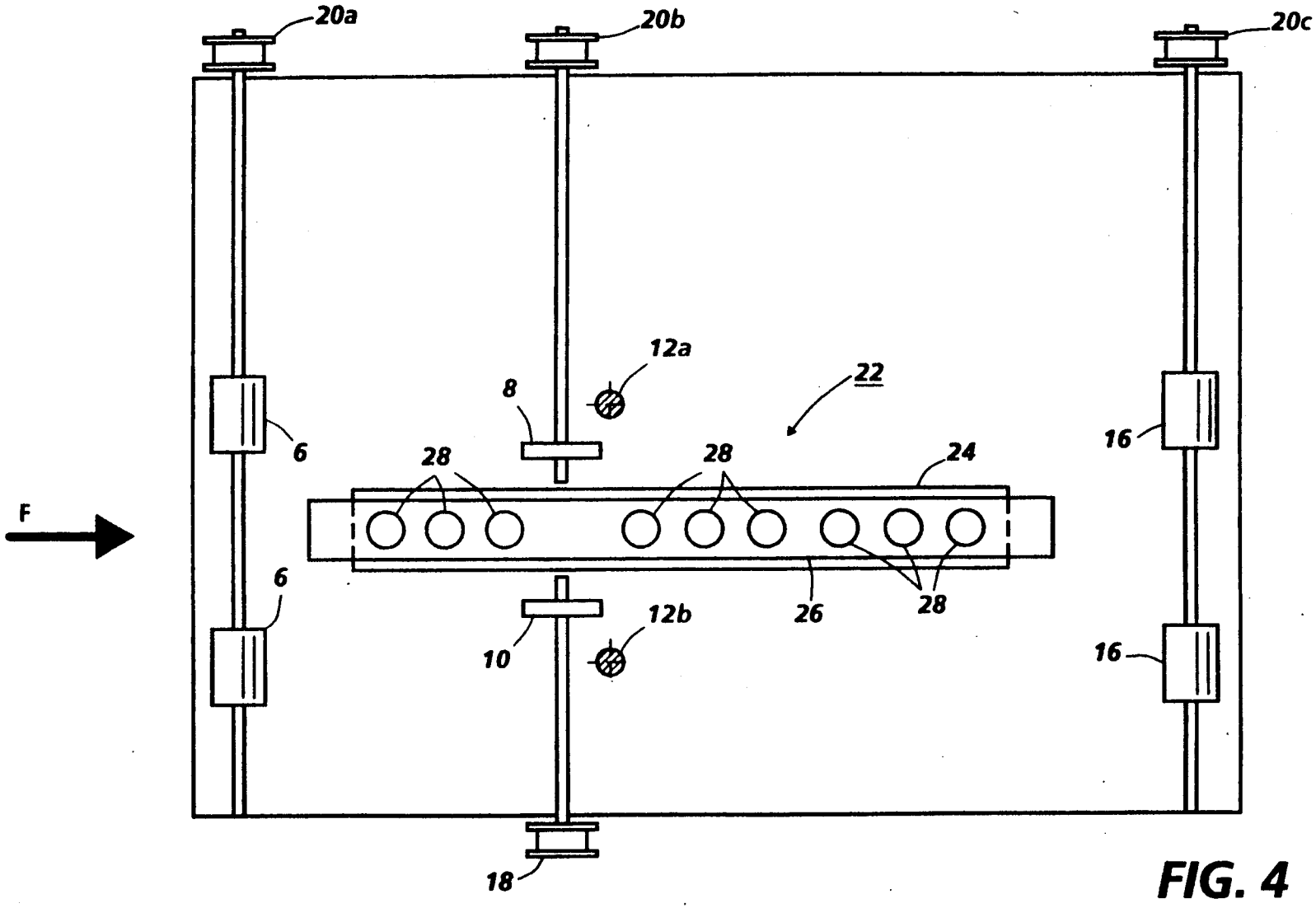
FIG. 4 is a schematic overhead plan view of a modified version of the embodiment illustrated in FIG. 1 which includes a ball-on-belt document conveying mechanism for conveying narrow sheets through the document turning device.

FIG. 4 is a schematic plan view of a modification of the first embodiment of the present invention. Instead of providing output rollers 14, a ball-on-belt conveying structure 22 can be provided to assist in conveying smaller sheets of paper towards and away from drive rollers 8 and 10. It should be noted that drive rollers 8 and 10 are also located closer to each other for handling smaller (narrower) sheets. Ball-on-belt conveyor 22 can be of a type well known in the art and includes a rotating conveyor belt 24 positioned on one side of the paper path and a housing 26 including a plurality of free rolling balls 28 therein which, when contacted with conveyor belt 24, provide a nip through which a sheet of paper is pressed against conveyor belt 24 to be moved thereby. Housing 26 is movable away from belt 24 so that a document can be freely rotated by drive roller 10. Housing 26 can be moved by a solenoid such as solenoid 13 used with output rollers 14.

Figure 5A:
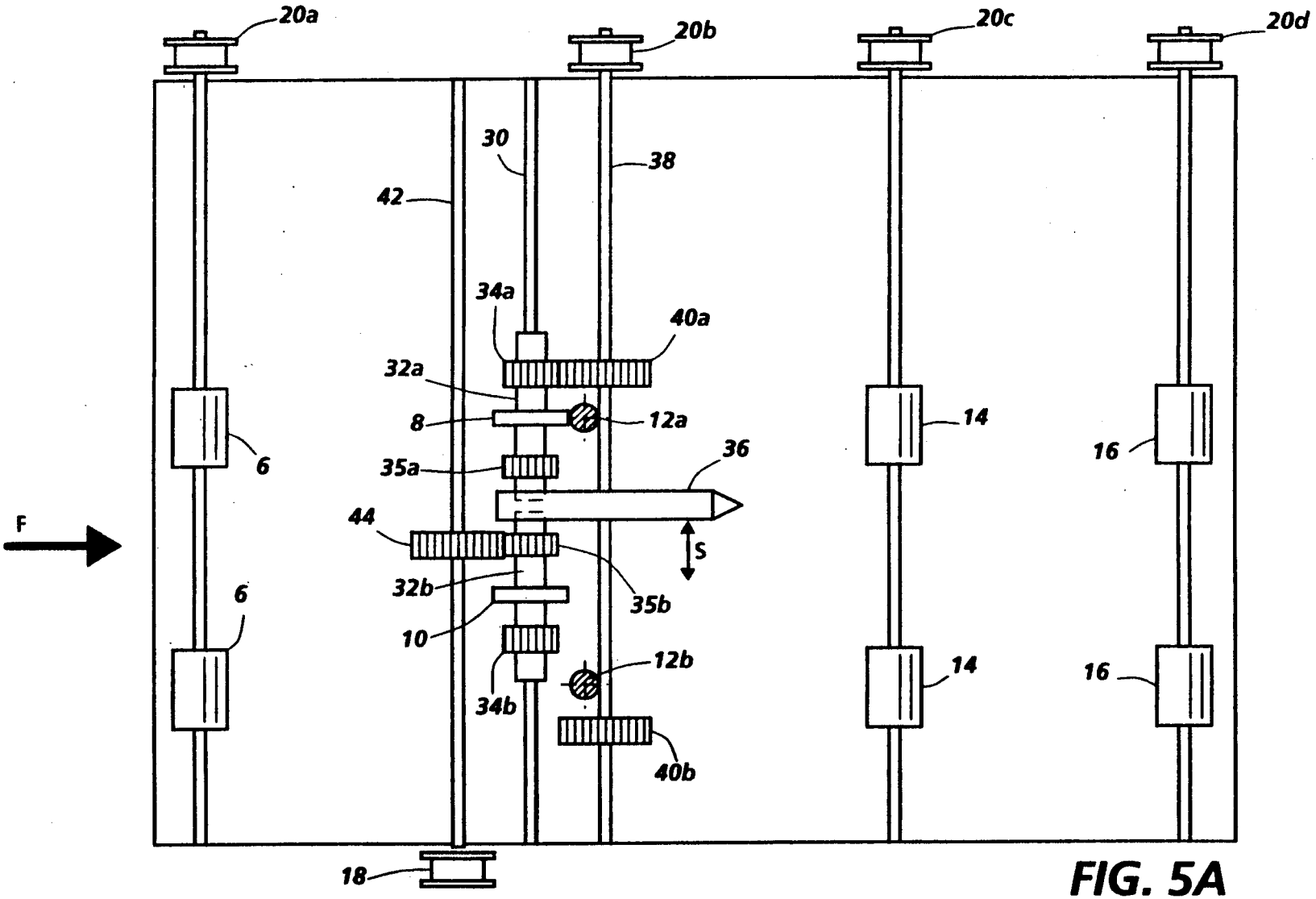
FIGS. 5A and 5B are schematic overhead plan views of a further modification of the embodiment illustrated in FIG. 1 wherein a shifting mechanism is included for selectively engaging each of the respective drive rollers with one of the constant speed drive and the variable speed drive for turning a document in either the clockwise or counterclockwise directions.
Figure 5B:
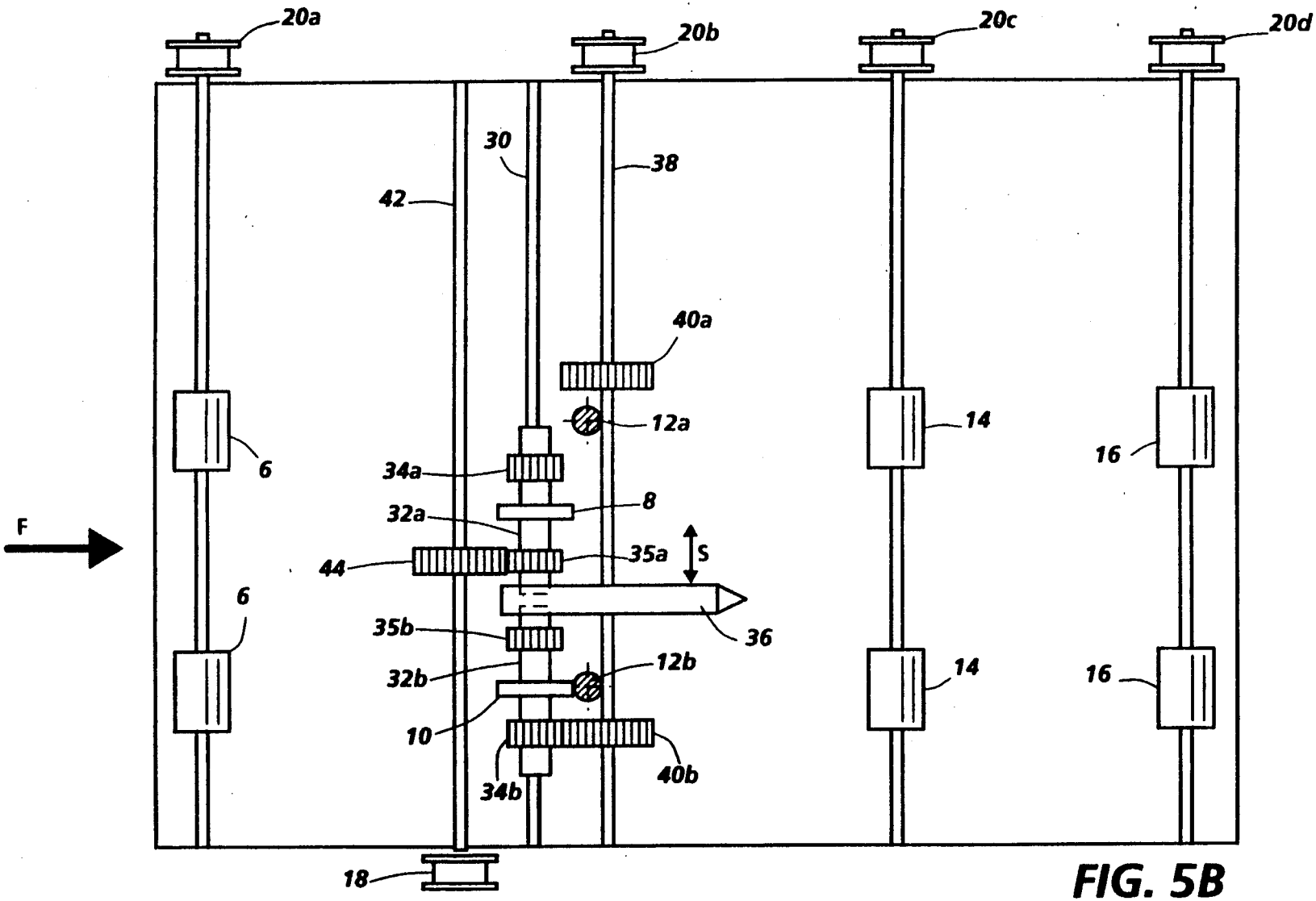

FIGS. 5A and 5B illustrate an additional modification to the first embodiment of the present invention wherein a shifting mechanism is provided for shifting the connection of the constant velocity drive motor and variable speed motor (stepper motor) between drive rollers 8 and 10 to provide for clockwise or counterclockwise rotation of a document. Practical considerations make it desirable to decelerate the variable speed roller 10 to a slower speed than the constantly driven roller 8 to achieve rotation rather than speeding up roller 10. Because of this, and in order to avoid using two step motors, the best way to convert a clockwise rotation system that has a constant velocity roller on the inboard side and a step motor driven roller on the outboard side, to a counterclockwise rotation system, is to simply switch the function of the two turn rollers 8, 10. A common shaft 30 is provided for each of drive rollers 8 and 10. Drive rollers 8 and 10 are mounted on respective sleeves 32*a*, 32*b* which are freely slidably and rotatably mounted on shaft 30. Each sleeve 32*a*, 32*b* includes a first gear 34*a*, 34*b*, respectively, for engaging a gear 40*a*, 40*b*, respectively, which is rotated at a constant velocity by first operating means 20*b* through shaft 38. A second gear 35*a*, 35*b* is provided on each of sleeves 32*a*, 32*b*, respectively and is selectively engageable with gear 44 which is rotated by the second operating means 18 (stepper motor) through shaft 42. Each of sleeves 32*a* and 32*b* is attached to a common linkage 36 which can be moved, for example, by hand, to move sleeves 32*a* and 32*b* and thus rollers 8 and 10 along the axis of shaft 30 to selectively engage each of rollers 8 and 10 with one of the constant velocity motor or variable speed motor. FIG. 5A illustrates the position of linkage 36 where drive roller 8 is attached to the constant velocity motor while drive roller 10 is attached to the variable speed motor for rotating documents in the clockwise direction. FIG. 5B shows the opposite arrangement for rotating documents in the counterclockwise direction. It is understood that linkage 36 can be operated manually or automatically by, for example, a solenoid or a motor.

Figure 6:
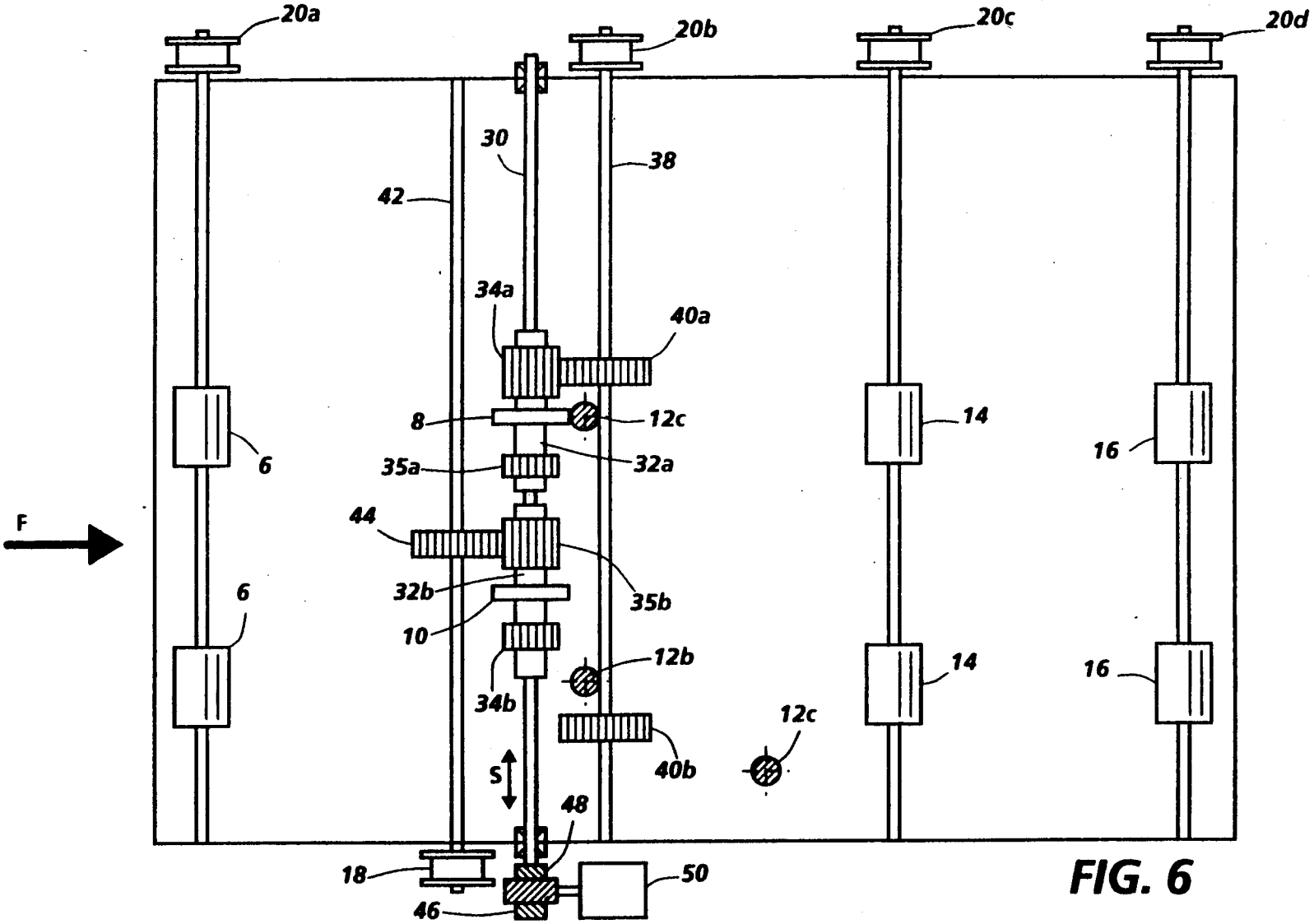
FIG. 6 is a schematic overhead plan view of a further modification of the embodiment illustrated in FIG. 1 which includes a mechanism for side registering sheets as well as for automatically shifting the drive rollers between the constant speed drive and the variable speed drive as well as including an additional sensor for side registering sheets which are not turned by the device.

FIG. 6 shows an arrangement where the switching of the attachments of drive rollers 8 and 10 to the first and second operating means 20*b* and 18, respectively, is controlled by a motor 50. In this embodiment, sleeves 32*a* and 32*b* are not freely slidable along the axis of shaft 30 but are mounted to freely rotate thereabout. Shaft 30 is movable along its axis by the operation of motor 50 which is attached to a worm gear 46 of shaft 30 through gear 48 which is attached to the shaft of motor 50. The embodiment illustrated in FIG. 6 can also be used to side register unrotated sheets as they pass through drive rollers 8 and 10. That is, as a sheet is captured between the nips formed between drive rollers 8 and 10 and their respective follower rollers, shaft 30 and thus drive rollers 8 and 10 can be shifted in the direction indicated by arrow S to properly orient a side edge of the document. Sensor 12*c* can be used to detect the side edge of the unrotated document. As stated earlier, side registration is not required when rotating documents because they are automatically side registered as they are rotated. It is also understood that turning device 2 can also operate to deskew documents which are passed therethrough without being rotated by sensing the input skew with sensors 12*a* and 12*b* and then varying the speed of drive roller 10 to deskew the document. In this mode of operation, device 2 functions somewhat like existing deskewing devices, however, only a single variable speed drive (e.g., step motor 18) is required to deskew documents.

Figure 7:
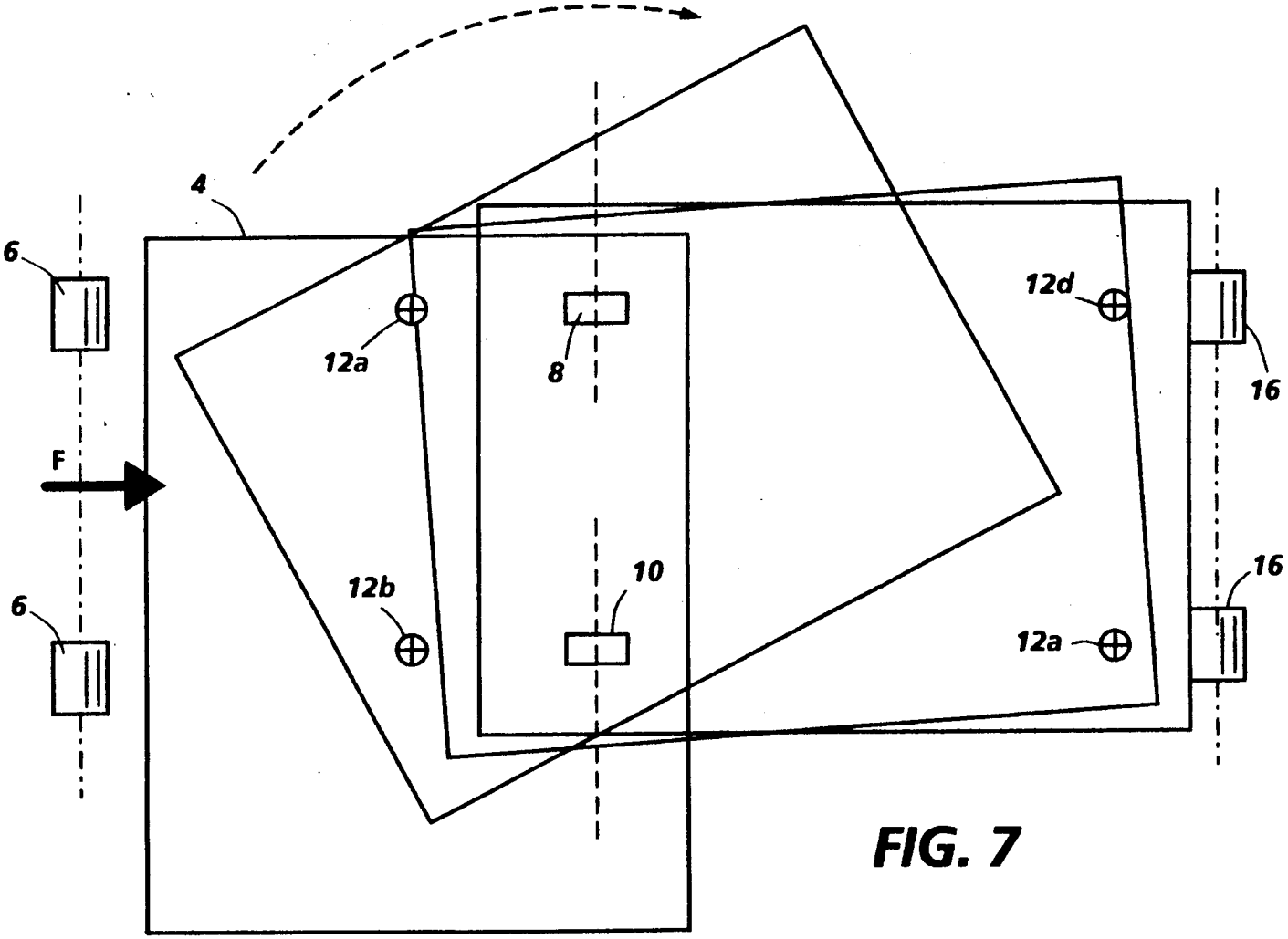
FIG. 7 is a schematic overhead plan view of a second embodiment of the present invention.

FIG. 7 illustrates a second embodiment of the present invention wherein skew sensors 12*a* and 12*b* are located upstream of drive rollers 8 and 10. This arrangement operates in a manner similar to that described above. The input skew is determined by sensors 12*a* and 12*b* which can also detect the output skew of the document after rotation. Since the sheet will still be in the nip produced by drive rollers 8 and 10 and their corresponding follower rollers when the output skew is determined by sensors 12*a* and 12*b*, not only can the output skew be used to update the variable velocity profile used to rotate subsequent documents, but the output skew of the document which was just rotated can also be corrected by appropriately controlling drive roller 10. However, when used with larger documents it may be impossible to detect the output skew after rotation if the sensors are located upstream of drive rollers 8 and 10. Thus, it may be necessary to provide two more sensors 12*d* and 12*e* downstream of drive rollers 8 and 10 which can be used to determine the output skew of the document to correct the velocity profile used to operate drive roller 10 for subsequent sheets to be passed through turning device 2. The embodiment illustrated in FIG. 7 can be operated using only three sensors in which case only one of sensors 12*a* and 12*b* would be provided to merely detect the presence of an incoming sheet. After waiting a predetermined time period so that the sheet is fed past drive rollers 8 and 10 by a specific distance, the velocity profile would be operated on drive roller 10 to rotate the sheet approximately 90°. The output skew of the sheet can then be determined using sensors 12*d* and 12*e* to either correct the skew of the rotated document by varying the speed of drive roller 10 or merely to correct the velocity profile used to rotate subsequent documents.

The present invention provides a number of advantages over previous sheet rotating systems. Since the sheets are always held in a positive nip, reliable operation and consistent rotation is ensured. The use of a positive nip also renders the present turning device more easily usable with documents having a variety of sizes. Since rotation and deskewing is accomplished without the use of edge guides, wear and buckling problems associated with edge registration technology is eliminated. The "intelligent" algorithm used with the present invention makes the system insensitive to roll wear and velocity drifts of the constant velocity motor. Only one step motor system and two sensors are required to accomplish both rotation and deskew, thus reducing construction and operation costs of the system. The system according to the present invention can be easily operated in a bypass mode without the use of additional gates or paper paths. Furthermore, by synchronizing the step motor to the constant velocity motor during the bypass operation, any drifting which does occur in the constant velocity motor does not result in skewing the documents passed therethrough.

The present invention can be used with any device which handles documents and is particularly useful with printers and copiers. The turning device of the present invention can be used to achieve set distinction between a plurality of sets of documents by, for example, rotating alternate sets by 90°. The present invention can also be used between a copier or printer and a finishing apparatus so that documents exiting the copier or printer can be properly oriented prior to entering the finishing apparatus. Letter size documents which exit an upstream apparatus long edge first can be rotated 90° so that they enter, for example, a buckle folder, saddle stitcher, or direct mail system short edge first. Legal size (14") sheets can be rotated, if necessary, so that they are fed short edge first to third party devices which compile and dual staple sheets along their top edge. A3/11×17" sheets produced by signature producing devices can be rotated, if necessary, so that they are fed short edge first to enable saddle stitching and/or folding as disclosed in the above-incorporated U.S. Pat. No. 4,727,402. Any number of other applications for the present invention are also available as well as rotating sheets fed short edge first so that they exit the turning device long edge first.

While the invention has been described with reference to particular preferred embodiments, the invention is not limited to the specific examples given. Other embodiments and modifications can be made by those skilled in the art without departing from the spirit and scope of the attached claims.

What is claimed is:

1. A device for selectively turning documents which are fed thereto, comprising:

input means for receiving documents which are moving in a process direction along a feed path;

document drive means disposed along said feed path for turning a selected document through an angle in its own plane, said document drive means including first and second drive rollers aligned along an axis which is transverse to said process direction, and first and second follower rollers cooperatively peripherally aligned with said first and second drive rollers, respectively;

a constant speed motor which operates at a single constant velocity attached to said first drive roller for operating said first drive roller at a substantially constant peripheral velocity; and a single variable speed motor having feedback control attached to said second drive roller for selectively operating said second drive roller at a peripheral velocity which varies so that said document is turned.

2. The device according to claim 1, wherein said variable speed motor operates said second drive roller at a peripheral speed which varies so that said document is turned 90°.

3. The device according to claim 1, further comprising:

determining means for determining a variable velocity profile which is used by said variable speed motor for operating said second drive roller at the peripheral velocity which varies.

4. The device according to claim 3, wherein said determining means determines said variable velocity profile to have an initial and a final value substantially equal to the velocity at which said constant speed motor drives said first drive roller, and an intermediate value different from said initial and final values to cause the document to turn.

5. The device according to claim 4, wherein said intermediate value is less than said initial and final values.

6. The device according to claim 3, further comprising:

skew detecting means for detecting the skew of a document as it is inputted into said document drive means.

7. The device according to claim 6, wherein said determining means determines said velocity profile based upon the skew detected by said skew detecting means.

8. The device according to claim 6, wherein said skew detecting means also detects the skew of the document after it has been turned by said document drive means.

9. The device according to claim 8, wherein said determining means determines the velocity profile for turning a subsequent document based upon the skew detected by said skew detecting means after the document has been turned.

10. The device according to claim 6, wherein said skew detecting means includes a first and a second sensor for detecting an edge of a document, said first and second sensors being spaced apart from each other and located upstream of said first and second drive rollers, relative to said process direction, along an axis which is transverse to said process direction.

11. The device according to claim 6, wherein said skew detecting means includes a first and a second sensor for detecting an edge of a document, said first and second sensors being spaced apart from each other and located downstream of said first and second drive rollers, relative to said process direction, along an axis which is transverse to said process direction.

12. The device according to claim 1, wherein said variable speed motor is a stepper motor attached to said second drive roller.

13. The device according to claim 1, wherein said variable speed motor is a servo motor attached to said second drive roller.

14. The device according to claim 3, further comprising:

bypass means for selectively causing said variable speed motor to operate said second drive roller at substantially the same peripheral velocity that said constant speed motor operates said first drive roller, based upon a bypass signal, so that documents are selectively fed through said turning device without being turned, said bypass means overriding said determining means when said bypass signal is present.

15. The device according to claim 14, wherein said bypass means includes monitoring means for monitoring the rotational velocity of said first drive roller, said bypass means causing said variable speed motor to operate said second drive roller based upon the rotational velocity monitored by said monitoring means.

16. The device according to claim 15, wherein said monitoring means is an optical encoder located adjacent said second drive roller.

17. The device according to claim 1, further comprising:

output driving means, located at least downstream of said document drive means relative to the process direction, for engaging the document after it has been turned and driving the document out of said turning device.

18. The device according to claim 17, wherein said output drive means is movable between an engaged position and a disengaged position, and including engaging means for placing said output drive means in the engaged position before and after a document is turned, and for placing said output drive means in the disengaged position while the document is being turned.

19. The device according to claim 18, wherein said output drive means includes two output drive rollers, attached to a common drive shaft and located downstream of said first and second drive rollers, and two output idler rollers cooperatively peripherally aligned with said two output drive rollers, one of said common drive shaft and said output idler rollers being movable toward and away from one of said output idler rollers and said drive shaft, respectively, to engage and disengage said output drive rollers with said output idler rollers, said engaging means being attached to one of said common drive shaft and said output idler rollers.

20. The device according to claim 18, wherein said output drive means includes a ball-on-belt-transport having a rotating endless belt assembly located on one side of said feed path and extending in a direction parallel to said process direction from a location upstream of said first and second drive rollers to a location downstream of said first and second drive rollers relative to the process direction, and an elongate ball housing having a plurality of balls freely rotatably disposed therein and extending partially out of a surface thereof, said ball housing being located on a side of said feed path opposite from said endless belt assembly, extending in the same direction and having substantially the same length as said endless belt assembly, said ball housing being movable toward and away from said endless belt to engage and disengage said plurality of balls with said belt to selectively engage and drive a document therebetween, said engaging means being attached to said ball housing.

21. The device according to claim 18, wherein said engaging means is a solenoid.

22. The device according to claim 1, further comprising:

shifting means for alternately attaching said constant speed motor to said first drive roller while attaching said variable speed motor to said second drive roller and attaching said constant speed motor to said second drive roller while attaching said variable speed motor to said first drive roller so that a document fed through said document drive means can be rotated clockwise or counterclockwise based on said shifting means.

23. The device according to claim 22, wherein said first and second drive rollers are freely rotatably mounted on an axially movable shaft, and said shifting means is attached to said axially movable shaft for shifting said axially movable shaft to a first position wherein said constant and variable speed motors are attached to said first and second drive rollers, respectively, and to a second position wherein said constant and variable speed motors are attached to said second and first drive rollers, respectively.

24. A device for selectively rotating and deskewing documents which are fed thereto, comprising:

input means for receiving documents which are moving in an process direction along a feed path;

document drive means disposed along said feed path for turning a selected document through an angle in its own plane, said document drive means including first and second drive rollers aligned along an axis which is transverse to said process direction, and first and second follower rollers cooperatively peripherally aligned with said first and second drive rollers, respectively;

a constant velocity motor which operates at a single constant velocity, attached to said first drive roller for rotating said first drive roller at a substantially constant peripheral velocity;

a single variable speed motor having feedback control, attached to said second drive roller for rotating said second drive roller at a peripheral velocity which varies;

skew detecting means for detecting the skew of a document as it is inputted into said document drive means; and means for determining a variable velocity profile for operating said variable speed motor so that a document is turned 90° and deskewed by varying the speed of the variable speed motor from the speed of the constant velocity motor, and for controlling said variable speed motor to operate according to said variable velocity profile.

25. The device according to claim 24, wherein said means for determining determines said variable velocity profile to have an initial and a final value substantially equal to the velocity at which said constant velocity motor drives said first drive roller, and an intermediate value different from said initial and final values to cause the document to turn.

26. The device according to claim 25, wherein said intermediate value is less than said initial and final values.

27. The device according to claim 24, wherein said skew detecting means also detects the skew of the document after it has been turned by said document drive means.

28. The device according to claim 27, wherein said means for determining determines the velocity profile for turning a subsequent document based upon the skew detected by said skew detecting means after the document has been turned.

29. The device according to claim 24, wherein said skew detecting means includes a first and a second sensor for detecting an edge of a document, said first and second sensors being spaced apart from each other and located downstream of said first and second drive rollers, relative to said process direction, along an axis which is transverse to said process direction.

30. The device according to claim 24, wherein said second operating means is a stepper motor attached to said second drive roller.

31. A device for selectively turning documents which are fed thereto, comprising:

input means for receiving documents which are moving in a process direction along a feed path;

document drive means disposed along said feed path for turning a selected document through an angle in its own plane, said document drive means including first and second drive rollers aligned along an axis which is transverse to said process direction, and first and second follower rollers cooperatively peripherally aligned with said first and second rollers, respectively;

output drive means, located at least downstream of said document drive means relative to the process direction, for engaging the document after it has been turned and driving the document out of said turning device;

first operating means, linked to said first drive roller and said output drive means, for operating said first drive roller and said output drive means at the same substantially constant peripheral velocity; and second operating means for selectively operating said second drive roller at a peripheral velocity which varies so that said document is turned.

32. The device according to claim 31, wherein said output drive means is movable between an engaged position and a disengaged position, and including engaging means for placing said output drive means in the engaged position before and after a document is turned, and for placing said output drive means in the disengaged position while the document is being turned.

33. The device according to claim 31, wherein said output drive means includes two output drive rollers, attached to a common drive shaft and located downstream of said first and second drive rollers, and two output idler rollers cooperatively peripherally aligned with said two output drive rollers, one of said common drive shaft and said output idler rollers being movable toward and away from one of said output idler rollers and said common drive shaft, respectively, to engage and disengage said output drive rollers with said output idler rollers, said engaging means being attached to one of said common drive shaft and said output idler rollers.

34. The device according to claim 31, wherein said output drive means includes a ball-on-belt-transport having a rotating endless belt assembly located on one side of said feed path and extending in a direction parallel to said process direction from a location upstream of said first and second drive rollers to a location downstream of said first and second drive rollers relative to the process direction, and an elongate ball housing having a plurality of balls freely rotatably disposed therein and extending partially out of a surface thereof, said ball housing being located on a side of said feed path opposite from said endless belt assembly, extending in the same direction and having substantially the same length as said endless belt assembly, said ball housing being movable toward and away from said endless belt to engage and disengage said plurality of balls with said belt to selectively engage and drive a document therebetween, said engaging means being attached to said ball housing.

35. The device according to claim 31, wherein said second operating means operates said second drive roller at a peripheral speed which varies so that said document is turned 90°.

36. The device according to claim 31, further comprising:

determining means for determining a variable velocity profile which is used by said second operating means for operating said second drive roller at the peripheral velocity which varies.

37. The device according to claim 36, wherein said determining means determines said variable velocity profile to have an initial and a final value substantially equal to the velocity at which said first operating means drives said first drive roller, and an intermediate value different from said initial and final values to cause the document to turn.

38. The device according to claim 36, further comprising:

skew detecting means for detecting the skew of a document as it is inputted into said document drive means.

39. The device according to claim 38, wherein said determining means determines said velocity profile based upon the skew detected by said skew detecting means.

40. The device according to claim 38, wherein said skew detecting means includes a first and a second sensor for detecting an edge of a document, said first and second sensors being spaced apart from each other and located downstream of said first and second drive rollers, relative to said process direction, along an axis which is transverse to said process direction.

41. The device according to claim 31, wherein said second operating means is a stepper motor attached to said second drive roller.

42. A device for selectively turning documents which are fed thereto, comprising:

input means for receiving documents which are moving in a process direction along a feed path;

document drive means disposed along said feed path for turning a selected document through an angle in its own plane, said document drive means including first and second drive rollers aligned along an axis which is transverse to said process direction, and first and second follower rollers cooperatively peripherally aligned with said first and second drive rollers, respectively;

first operating means for operating said first drive roller at a substantially constant peripheral velocity;

second operating means for selectively operating said second drive roller at a peripheral velocity which varies so that said document is turned;

skew detecting means for detecting the skew of a document after the document has been turned by said document drive means; and determining means for determining a variable velocity profile which is used by said second operating means for operating said second drive roller at a peripheral velocity which varies, said determining means determining the velocity profile for turning a subsequent document based upon the skew detected by said skew detecting means after the document has been turned.

43. A device for selectively turning documents which are fed thereto, comprising:

input means for receiving documents which are moving in a process direction along a feed path;

document drive means disposed along said feed path for turning a selected document through an angle in its own plane, said document drive means including first and second drive rollers aligned along an axis which is transverse to said process direction, and first and second follower rollers cooperatively peripherally aligned with said first and second drive rollers, respectively;

first operating means for operating said first drive roller at a substantially constant peripheral velocity;

second operating means for selectively operating said second drive roller at a peripheral velocity which varies so that said document is turned; and shifting means for alternately attaching said first operating means to said first drive roller while attaching said second operating means to said second drive roller and attaching said first operating means to said second drive roller while attaching said second operating means to said first drive roller so that a document fed through said document drive means can be rotated clockwise or counterclockwise based on said shifting means.

44. The device according to claim 43, wherein said first and second drive rollers are freely rotatably mounted on an axially movable shaft, and said shifting means is attached to said axially movable shaft for shifting said axially movable shaft to a first position wherein said first and second operating means are attached to said first and second drive rollers, respectively, and to a second position wherein said first and second operating means are attached to said second and first drive rollers, respectively.

* * * * *